US006439440B1

(12) United States Patent
Lasserre

(10) Patent No.: US 6,439,440 B1
(45) Date of Patent: Aug. 27, 2002

(54) DISPENSING HEAD FOR DISPENSING PRODUCT

(75) Inventor: Pierre-André Lasserre, Coubron (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/986,028

(22) Filed: Nov. 7, 2001

(30) Foreign Application Priority Data

Nov. 7, 2000 (FR) ..... 00 14253

(51) Int. Cl.[7] ..... B65D 83/00
(52) U.S. Cl. ..... 222/402.21; 222/288; 222/321.6
(58) Field of Search ..... 222/182, 288, 222/402.13, 402.21, 562, 321.6

(56) References Cited

U.S. PATENT DOCUMENTS

| | | | | |
|---|---|---|---|---|
| 2,767,888 A | | 10/1956 | Soffer | |
| 3,233,788 A | | 2/1966 | Diamond | |
| 3,901,410 A | * | 8/1975 | Schultz | 222/402.13 |
| 4,944,429 A | * | 7/1990 | Bishop et al. | 222/182 |
| 5,031,800 A | | 7/1991 | Brunet | |
| 5,722,568 A | * | 3/1998 | Smith | 222/402.21 |

FOREIGN PATENT DOCUMENTS

| | | |
|---|---|---|
| CH | 679 660 | 3/1992 |
| FR | 2 570 000 | 3/1986 |
| FR | 2 635 085 | 2/1990 |

OTHER PUBLICATIONS

English language Derwent Abstract of CH 679 660, Mar. 31, 1992.
English language Derwent Abstract of FR 2 570 000, Mar. 14, 1986.
English language Derwent Abstract of FR 2 635 085, Feb. 9, 1990.

* cited by examiner

*Primary Examiner*—Philippe Derakshani
*Assistant Examiner*—Thach H Bui
(74) *Attorney, Agent, or Firm*—Finnegan, Henderson, Farabow, Garrett & Dunner L.L.P.

(57) ABSTRACT

A dispensing head for dispensing a product from a receptacle associated with an actuatable dispensing element. The dispensing head comprises a mounting element configured to be fixed to the receptacle, and at least one dispensing orifice. The dispensing head further may comprise a dispensing nozzle forming a channel configured to pass product to the at least one dispensing orifice. The nozzle may be configured to be rotatably fixed relative to the mounting element and also be configured to be displaced so as to cause actuation of the dispensing element. The dispensing head may also comprise a cap configured to be screwed onto the dispensing nozzle. The cap may be configured to prevent the actuation of the dispensing element when the cap is in a screwed-on position on the dispensing nozzle.

26 Claims, 3 Drawing Sheets

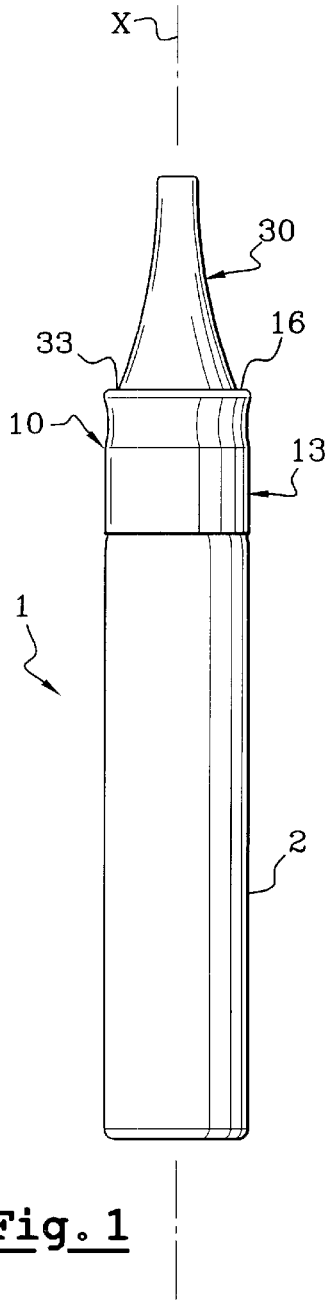
Fig. 1
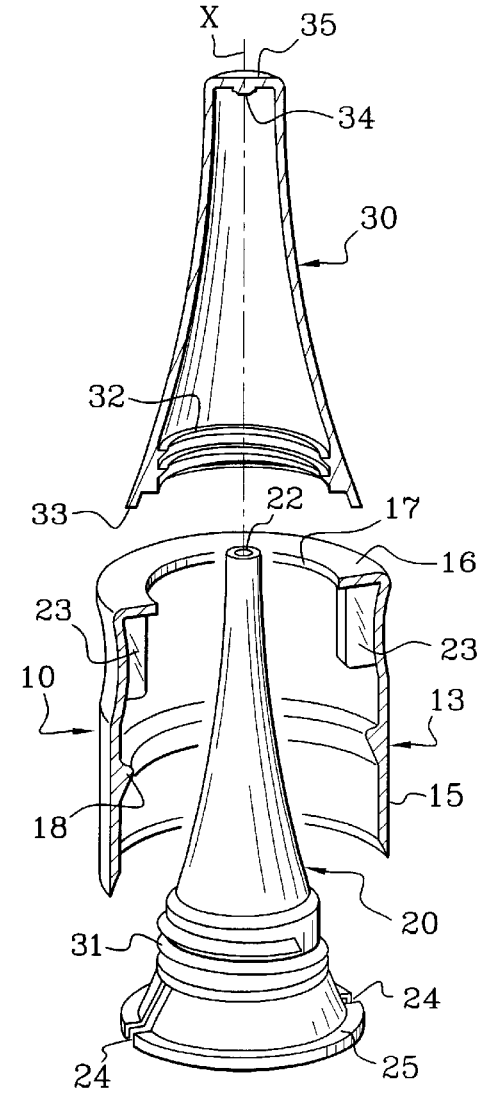
Fig. 2
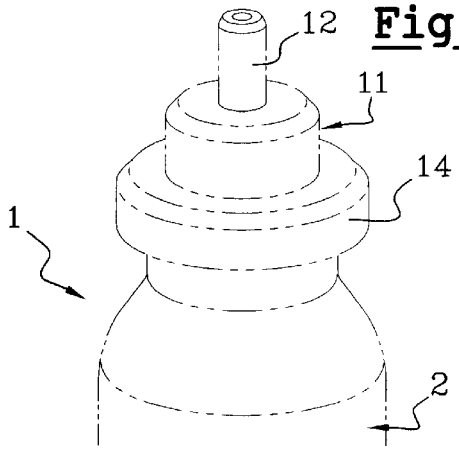

DISPENSING HEAD FOR DISPENSING PRODUCT

The present invention relates to a dispensing head for dispensing a product such as a cosmetic product. For example, the dispensing head could be used for dispensing product from a receptacle containing the product in a pressurized state. Such a product may be in the form of a liquid or a foam, or have a more viscous consistency, such as in the form of a cream or a gel. The product could be chosen from a care product, a make-up product, body-hygiene product, a hair-care product, and a sun-screen product.

The dispensing head could be part of a device including a valve, and the product may be pressurized by, for example, a liquefied or non-liquefied propellant gas. The gas may be packaged directly in contact with the product or separately via a piston or a pouch with flexible walls.

French Patent Application 2,635,085 describes a distributor for dispensing a liquid by a pumping action. A cap is positioned over a dispensing nozzle of the distributor between uses. The problems posed by the configuration shown in French Patent Application 2,635,085 are many. For example, unexpected actuation of the valve on the receptacle is likely to occur when the cap is mounted on the device, particularly if the valve has a short actuation stroke.

Moreover, when the cap is fully mounted on the device the dispensing orifice of the dispensing nozzle is not closed off in a leak-tight manner. Therefore, the dispensing orifice and the channel leading to the dispensing orifice tend to be subject to fouling, particularly when a product with a strong tendency to clog when drying is contained in the receptacle. Such fouling of the dispensing orifice and channel may render the device unusable, particularly after a long period of non-use. Furthermore, the residual product in the channel and in the vicinity of the orifice is prone to degradation due at least partially to oxidation, and is prone to be unattractive in appearance.

If the cap is modified so that the dispensing orifice is closed off in a leak-tight manner by the cap when the cap is in the mounted position, other problems result. In particular, with such a modification, the risk of unexpected actuation of the valve increases when mounting the cap on the device.

U.S. Pat. No. 2,767,888 describes a device in which a cap is screwed onto a tilt stem valve. Such a design suffers from several drawbacks. The first drawback is that there is no coupling to prevent rotation between the tilt stem valve and the collar. Therefore, the cap might not be screwed on sufficiently. Moreover, even if the cap is screwed on sufficiently, it is possible that the tilt stem valve will rotate with the cap during the unscrewing movement, thereby making it impossible to remove the tilt stem valve. The drawbacks are greater when, after use, a product residue is able to flow along the tilt stem valve and soil the thread of the cap, thereby possibly causing adhesion to the thread of the cap. The risk of soiling of the thread is increased because the tilt stem valve is relatively short and cylindrical and because the thread is located on a portion of the tilt stem valve which has a cross-section similar to the cross-section of the rest of the tilt stem valve.

A need exists for a device for dispensing a product, such as a cosmetic product, that may remedy at least one of the above-mentioned drawbacks.

In particular, a need exists for a device with a low risk of unexpected actuation of the dispensing element.

Further, it may be desirable to provide a device with reduced risks of clogging and fouling of the dispensing orifice and/or of the channel leading to the dispensing orifice.

It may also be desirable to produce a device wherein the protective cap may be screwed onto and unscrewed from the dispensing nozzle in a simple and satisfactory manner, and wherein there is a minimal risk of soiling the thread of the nozzle.

A need further exists to supply a device which may be manufactured and assembled economically and which is simple to use.

It should be understood that the invention could be practiced without satisfying one or more of the needs described above and/or without performing one of more of the objects and/or advantages described above.

As embodied and broadly described herein, one aspect of the invention includes a dispensing head for dispensing a product from a receptacle associated with an actuatable dispensing element. The dispensing head comprises a mounting element configured to be fixed to the receptacle, and at least one dispensing orifice. The dispensing head may further comprise a dispensing nozzle forming a channel configured to pass product to the at least one dispensing orifice. The nozzle may be configured to be rotatably fixed relative to the mounting element and may also be configured to be displaced so as to cause actuation of the dispensing element. The dispensing head may also comprise a cap configured to be screwed onto the dispensing nozzle. The cap may be configured to prevent the actuation of the dispensing element when the cap is in a screwed-on position on the dispensing nozzle.

Another aspect of the invention includes a dispensing device comprising a receptacle, a product contained in the receptacle, an actuatable dispensing element associated with the receptacle, and a dispensing head.

With at least one optional embodiment of the present invention, by way of example only, the risk of unexpected actuation of the dispensing element may be minimized because the cap is screwed directly onto the nozzle, creating no force that would cause unexpected actuation. Instead of generating force on the valve, the screwing of the cap onto the dispensing nozzle may tend to draw the dispensing nozzle away from the valve. Moreover, in the storage position where the cap is screwed onto the nozzle, the risk of unexpected actuation may further be minimized by an edge of cap configured to be substantially in contact with at least one portion of a collar of the mounting element. Such a configuration may make it possible to produce a dispensing head whose appearance is similar to dispensing heads used for receptacles having a tube form. This arrangement could be used for marketing a product such as a care cream or gel, which is traditionally packaged in a tube.

Optionally, when the dispensing nozzle is rotatably fixed relative to the mounting element, the cap may be screwed tightly onto the dispensing nozzle. This could create an effective seal upon closure of the cap and minimize the risk of unexpected actuation of the dispensing element when the device is in the storage position. Upon opening, the nozzle may be fixed in rotation relative to the cap, which might be removed easily irrespective of the extent of screwing-on.

According to an exemplary embodiment, the dispensing nozzle may further comprise threading configured to interact with a corresponding threading on the cap. In yet another aspect of an exemplary embodiment of the invention, the threading of the dispensing nozzle is positioned on a portion of the nozzle having a larger cross-section than the cross-section of the free end of the nozzle where the dispensing orifice is located. In such an embodiment, the threaded portion of the nozzle could be separated from the free end of the nozzle by at least a portion of the nozzle with a cross-section which increases progressively in the direction of the threaded portion. Alternatively (or additionally), the threaded portion of the nozzle may be separated from the free end of the nozzle by one or more shoulders or other portions with a cross-section which increases progressively. The shoulders or other portions with a cross-section which increases progressively could function to delay or prevent the product from reaching the threading. Moreover, such an arrangement could simplify the design of the cap, by allowing the arrangement of the threading of the cap on the inner surface of its outer lateral wall, without having an intermediate inner wall, for example.

In an exemplary embodiment, the dispensing nozzle may be made from a piece distinct from a collar of the mounting element. As used herein, the term "distinct" relates to the fact that the dispensing nozzle and the collar being made from separate pieces which, at least after the first use, are independent of one another, except for their rotational coupling. In other words, at least after the first use, the dispensing nozzle and collar might not be connected by any bridge of material such as a film hinge. For example, the two pieces could be molded separately. Alternatively, during molding, the two pieces may be connected by bridges of material which could be broken at the time of the first use and therefore constitute an indication of tampering.

The optional arrangement where the dispensing nozzle is a piece distinct from the collar may facilitate the mounting of the dispensing head on the receptacle and may assist in minimizing the risk of unexpected actuation of the valve during such mounting. Moreover, in some embodiments, the provision of the dispensing nozzle and collar as distinct pieces could be used when the valve is a tilt or rocking-type valve. In a rocking-type valve, actuation of the valve might occur irrespective of the angular position of the lateral force causing the rocking movement.

In an exemplary embodiment, the dispensing element comprises a valve, and the product is pressurized inside the receptacle. In such an embodiment, a valve with a short actuation stroke might facilitate dispensing of the product.

According to one embodiment, the valve is a tilt-type valve configured to be actuated in response to a force transverse to a longitudinal or axial axis of the valve. With this configuration, the product may be dispensed directly onto the surface where the product is to be applied by placing the dispensing nozzle in engagement with the surface to be treated and displacing the dispensing nozzle relative to the surface.

According to another embodiment, the valve is a push-in-type valve configured to be actuated in response to a force oriented along a longitudinal or axial direction of the valve.

The mounting collar may be mounted securely on the receptacle, particularly by clamping snap-fitting. Alternatively, it may be screwed onto the receptacle. A variety of other known mounting methods are also acceptable.

The dispensing nozzle may be rotatably fixed relative to the collar by at least one tooth on one of the collar and the dispensing nozzle configured to engage a corresponding number of grooves on the other of the collar and the dispensing nozzle. Any number of teeth may be provided. It may be desirable to have a larger number of teeth in order to ease the operation of mounting the dispensing head. By way of example only, the number of teeth may range from one to several dozen. Typically, the number of teeth may range from two to six, or from two to four. As used herein, a "tooth" is defined as any type of projection that is configured to engage a groove to prevent rotational movement between two members.

In one aspect of the invention, the dispensing head may include an element, particularly in the form of an annular collar, which, in interaction with a corresponding portion of the mounting element or collar, prevents detachment of the dispensing nozzle from the rest of the dispensing head. In one exemplary embodiment, the annular element is provided on the dispensing nozzle. Moreover, this annular element, during actuation of the dispensing element through rocking, is able to engage with the corresponding portion of the mounting element and to act in the manner of a lever arm. In one exemplary embodiment, the annular collar of the dispensing nozzle defines an outer diameter that is greater than an inner diameter of the corresponding portion of the mounting element, thereby preventing detachment of the dispensing nozzle from the remainder of the dispensing head. Dispensing of the product is further facilitated by the annular element of the dispensing nozzle.

In another aspect of the invention, the dispensing head may include an edge configured to prevent the actuation of the dispensing element when the cap is in the screwed-on position. The edge could be provided on the cap. When the cap is in the screwed-on position on the dispensing nozzle, the edge is substantially in contact with the mounting element or collar, thereby preventing the actuation of the dispensing element. In an exemplary embodiment, the edge of the cap is an annular edge. Other shapes are contemplated. In one embodiment, the annular edge is substantially in contact with an annular rim provided on the mounting element or collar. The word "substantially" reflects the fact that the play which exists between the annular edge of the cap and the mounting element or collar is smaller than the stroke required to cause opening of the dispensing element. Such play, when the dispensing element is a valve, may be of the order of 0.5 mm. It is to be understood that the amount of play may be smaller or greater, however.

In another exemplary embodiment, the cap may be configured such that, in the screwed-on position on the nozzle, a portion of the cap is in engagement with the dispensing orifice in order to close off the dispensing nozzle in a leak-tight manner. Because the cap is screwed directly onto the dispensing nozzle, the risk of unexpected actuation of the dispensing element during mounting of the cap on the dispensing nozzle could be minimized, regardless of the extent of engagement of the cap with the dispensing orifice, for example.

The device according to the invention may be used for the packaging and dispensing of a wide variety of products from a receptacle. For example, the device could be used to dispose a cosmetic product, such as a care, make-up, body-hygiene, hair-care or sun-screen product.

Aside from the arrangements set forth above, the invention may comprise any number of other arrangements. The accompanying drawings are included to provide a further understanding of the invention and are incorporated in and constitute a part of this specification. The drawings illustrate exemplary embodiments of the invention and, together with the description, serve to explain certain principles. In the drawings, FIG. 1 is a side view of an exemplary embodiment of a device according to the present invention;

FIG. 2 is an exploded view of the top portion of the device of FIG. 1 with certain components shown in cross-section;

Reference will now be made in detail to exemplary embodiments of the invention, examples of which are illustrated in the accompanying drawings. Wherever possible, the same reference numbers are used in the drawings and the description to refer to the same or like parts.

Figure 3A:
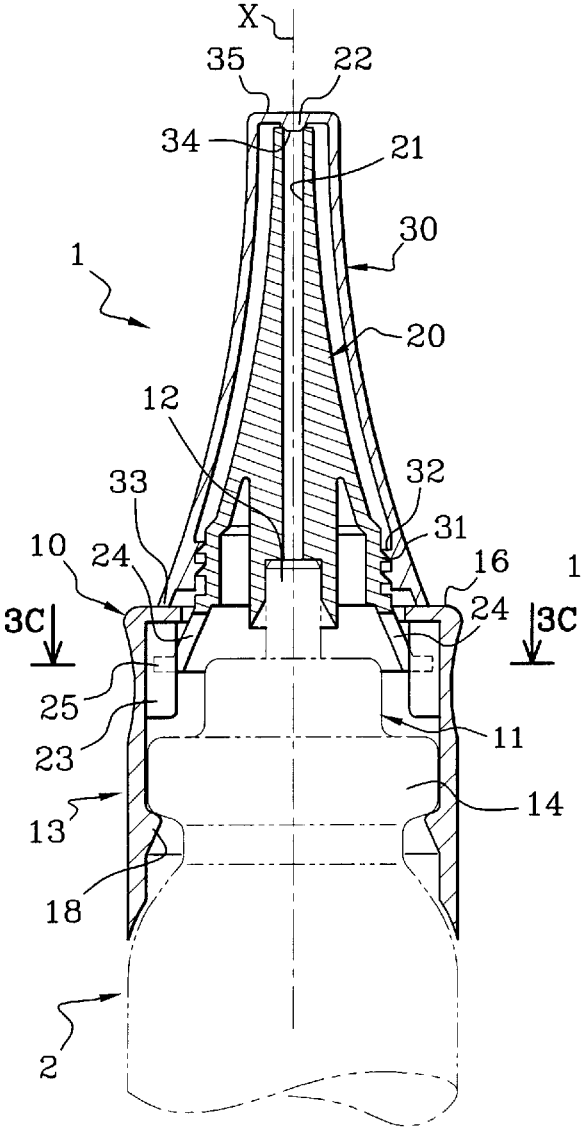
FIG. 3A is a cross-sectional side view of the top portion of the device of FIG. 1, with a dispensing element in an unactuated position.

As shown in the embodiments of FIGS. 1, 2, and 3A–3C, a device 1 comprises a container 2 containing a product and a gas capable of pressurizing the product. The container may made from any acceptable material such as aluminum or tin plate. A valve 11 of the rocking type is attached to the top of the receptacle 2. The valve 11 comprises a valve spindle 12 emerging outside the valve and receptacle. The receptacle 2 may be equipped with a dispensing head 10 for the actuation of the valve 11 and the dispensing of the product under pressure.

The dispensing head 10 may comprise a mounting element including a collar 13 mounted by a clamping snap-fitting on a crimping bead or projection 14 of the valve 11. The collar 13 comprises a cylindrical skirt 15, one end of which is open and the other end of which may comprise an annular rim 16 delimiting an opening 17. The inner surface of the skirt 15 may be provided with a bead or inner projection 18 for the snap-fitting of the collar 13 over the crimping projection 14 of the valve.

The dispensing head 10 may further comprise a dispensing nozzle 20. The dispensing nozzle 20 may be traversed by a channel 21 arranged along the longitudinal axis (labeled X) of the valve 11. The dispensing nozzle may be mounted on the valve by a number of methods, including clamping. In the embodiment shown in FIGS. 3A and 3B, the dispensing nozzle is mounted in a clamping manner on the valve spindle 12. The channel 21 emerges at a dispensing orifice 22, at an end opposite the valve spindle 12. In the embodiment shown in FIGS. 3A and 3B, the nozzle 20 has a cross-section which increases progressively between the dispensing orifice 22 and the threading 31 provided opposite the dispensing orifice. Other geometries besides those including a progressively increasing diameter are also acceptable.

Figure 3B:
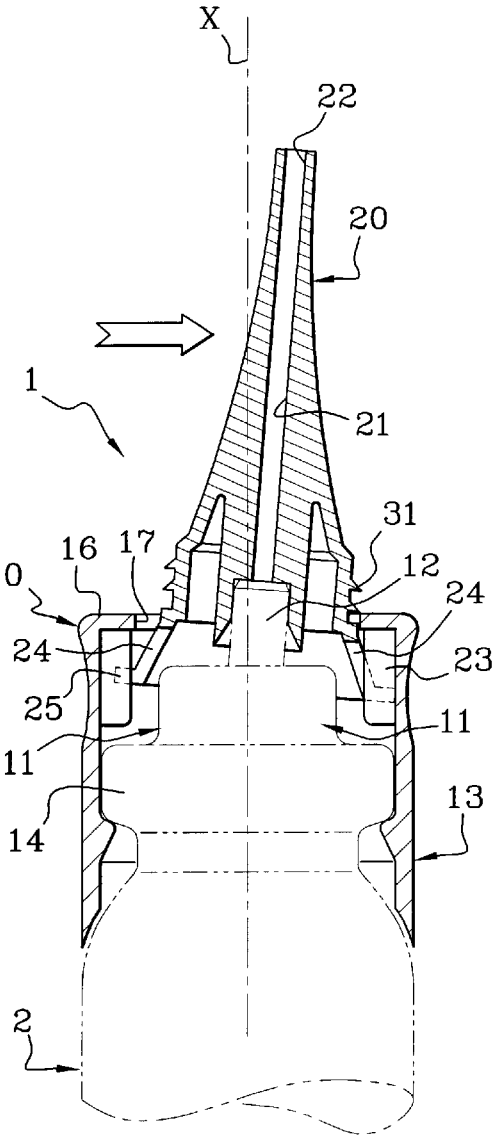
FIG. 3B is a cross-sectional side view of the top portion of the device of FIG. 1, with a cap removed and with the dispensing element in an actuated position.
Figure 3C:
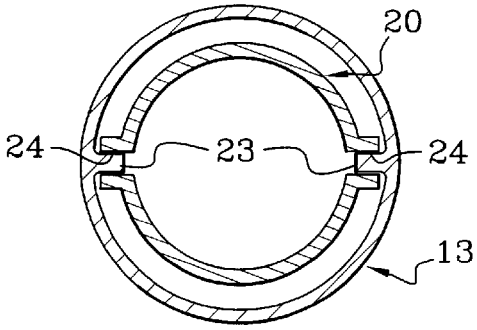
FIG. 3C is a cross-sectional view of the device taken along line 3C—3C of FIG. 3A.

As best shown in FIGS. 2 and 3C, the dispensing nozzle 20 may be rotationally coupled with the collar 13 via an arrangement comprising a plurality of teeth 23 formed on the inner surface of collar 13 and configured to engage grooves 24 of corresponding geometry positioned on the outer surface of the dispensing nozzle 20. Alternately, the teeth could be provided on the dispensing nozzle and the grooves provided on the collar.

At the end opposite the dispensing orifice 22, the dispensing nozzle 20 forms a transverse collar 25 which faces outwards and the maximum diameter of which is greater than the internal diameter of the annular rim 16 of the collar 13. Thus, the collar 25 may prevent the dispensing nozzle 20 from detaching from the rest of the dispensing head. In the embodiment shown in FIGS. 2 and 3A–3C, the grooves 4 are positioned on the transverse collar 25. It should be understood that the grooves may be placed on structures other than the transverse collar 25.

In the example shown, a cap 30 with a flared profile, similar to the profile of the dispensing nozzle 20, may be screwed directly onto the dispensing nozzle 20. To this end, the dispensing nozzle 20 comprises threading 31 on its outer surface, in the vicinity of its end opposite the orifice 22. The threading 31 is configured to interact with corresponding threading 32 formed on the inner surface of the cap 30 in the vicinity of its open end. It should be understood that the cap may have any variety of sizes and shapes besides that shown in the figures.

In the screwed-on position of the cap (also referred to as the storage or transportation position), as shown in FIGS. 1 and 3A, an edge 33 delimiting the open end of the cap 30 may be substantially in contact with the annular rim 16 of the collar 13. This contact between edge 33 and annular rim 16 when the cap is in the screwed-on position prevents the cap from being able to rock substantially about the longitudinal axis (x-axis) of the valve. This configuration minimizes the risk of unexpected actuation of the valve 11 when the device is in the storage or transportation position.

In the position in which the cap 30 is screwed onto the dispensing nozzle 20, an inner projection or bead 34 formed by the base 35 of the cap contacts the end of the dispensing nozzle that defines the dispensing orifice 22. This contact results in a leak-tight engagement between bead 34 of the cap and dispensing orifice 22 of the dispensing nozzle 20, thereby preventing, between two uses, clogging of the dispensing orifice 22 or of the channel 21 by any residual product at this location. This characteristic might be useful when the product is highly viscous. Moreover, this leak-tight closure of the dispensing orifice 22 prevents the deterioration of any residual product inside the channel 21, particularly for easily oxidizable products.

The device shown in FIGS. 1–3C may be used as follows. First, the user unscrews the cap 30 from the dispensing nozzle 20. The user then places the dispensing orifice 22 so that it bears on the surface to be treated (e.g., the skin and/or hair) and displaces the device 1 relative to the surface. Such a bearing action gives rise to the rocking of the valve spindle 12, thereby opening the valve 11 and causing the release of the product through the orifice 22 via the axial channel 21. FIG. 3B illustrates an example of a configuration of the valve 11 in the rocked position of both the nozzle 20 and the valve spindle 12.

After use, the user screws the cap 30 back onto the dispensing nozzle 20 without generating a force likely to cause rocking of the valve spindle 12. Screwing-on continues until the edge 33 of the cap 30 reaches the close proximity of the annular rim 16 of the collar as shown in FIG. 3A. Full screwing of the cap 30 onto the dispensing nozzle 20 is facilitated by the rotational coupling of the dispensing nozzle 20 and the collar 13 which is itself rotatably fixed relative to the receptacle 2.

Naturally, the invention is not limited to the example described above.

Another non-limiting embodiment of a device for dispensing a product from a receptacle is described below.

Figure 4A:
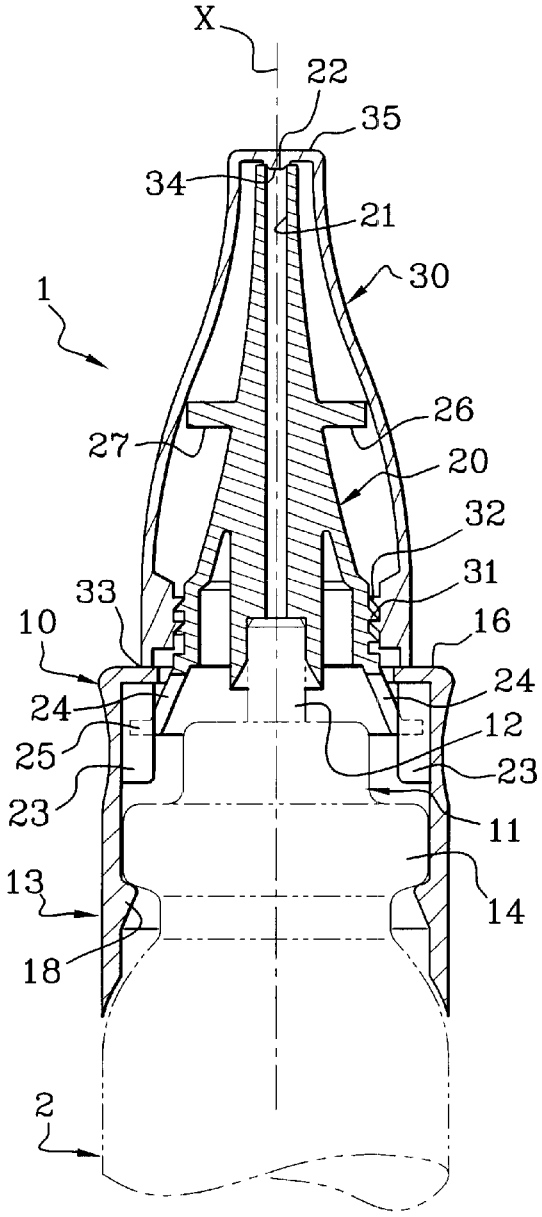
FIG. 4A is a cross-sectional side view of a top portion of another embodiment of a device according to the present invention, with the dispensing element in an unactuated position.
Figure 4B:
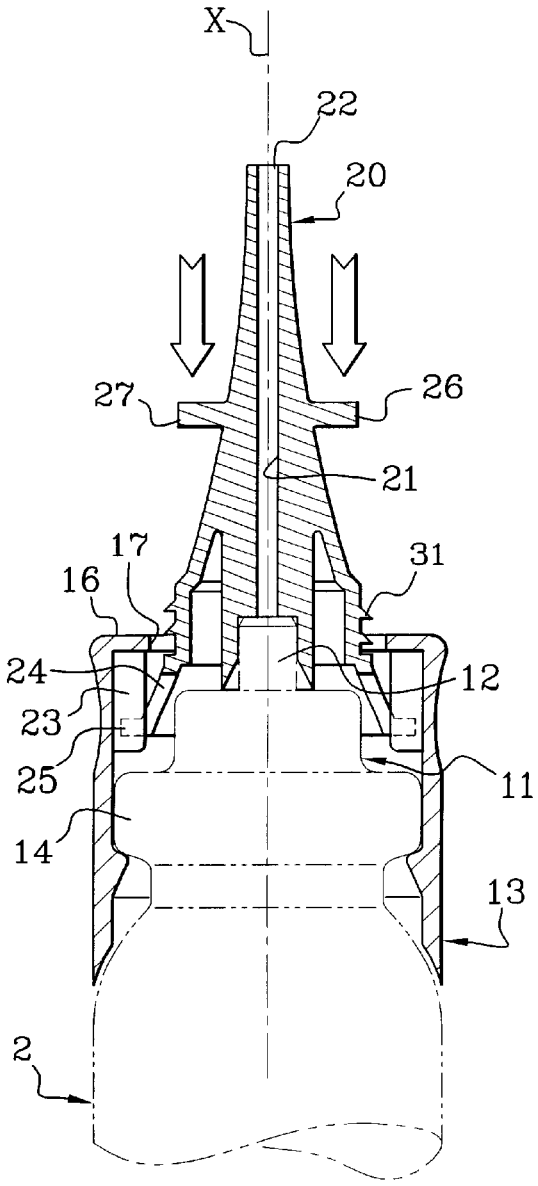
FIG. 4B is a cross-sectional side view of the device of FIG. 4A, with a cap removed and with the dispensing element in an actuated position.

The embodiment of FIGS. 4A and 4B is distinguished from the preceding embodiment in that the valve 11 is of the push-in type. In such an embodiment, the dispensing nozzle 20 may include two "lugs" 26, 27 configured to receive a force capable of actuating the valve by an axial displacement of the nozzle 20 in the direction of the receptacle 2 along the longitudinal axis X. The lugs may be contacted by the fingers of the user or by other means during actuation of the valve. FIG. 4A shows the dispensing head with the cap in the screwed-on position. FIG. 4B shows the dispensing head with the dispensing nozzle in the downward or actuated position. In FIG. 4B, the dispensing nozzle has been pressed downward by the user in order to actuate the valve.

In this alternate embodiment, the profile of the cap is different from the profile of the cap of the preceding embodiment so that, during screwing of the cap onto the dispensing nozzle 20 as shown in FIG. 4A, the cap 30 does not engage with the lugs of the nozzle 20. The engagement is avoided in order to prevent an unexpected and undesired actuation of the valve 11.

The device 1 is otherwise similar to that of the preceding embodiment.

In the exemplary embodiments shown in the drawings, during screwing of the cap 30 onto the dispensing nozzle 20, there is little risk of unexpected actuation of the valve 11 because no force capable of causing such actuation is generated by the screwing movement. The rotational coupling of the collar 13 and the dispensing nozzle 20 allows significant clamping of the cap 30 on the nozzle 20. This clamping ensures adequate sealing on closure. In the position in which the cap 30 is screwed onto the nozzle 20, the edge 33 of the cap 30 is substantially in contact with the annular rim 16 of collar 13, rendering actuation of the valve 11 highly unlikely.

The invention is not limited to the exemplary embodiments described above. For example, the invention is not limited to dispensing a cosmetic product, but also may be used for other substances, such as dermatological or pharmaceutical products.

The device and dispensing head also may have shapes and sizes other than those described above.

It will be apparent to those skilled in the art that various modifications and variations can be made to the structure. Thus, it should be understood that the invention is not limited to the examples discussed in the specification. Rather, the present invention is intended to cover modifications and variations.

What is claimed is:

1. A dispensing head for dispensing a product from a receptacle associated with an actuatable dispensing element, the dispensing head comprising:

a mounting element configured to be fixed to the receptacle;

at least one dispensing orifice;

a dispensing nozzle forming a channel configured to pass product to the at least one dispensing orifice, the nozzle being configured to be rotatably fixed relative to the mounting element and being configured to be displaced so as to cause actuation of the dispensing element; and a cap configured to be screwed onto the dispensing nozzle, the cap being configured to prevent the actuation of the dispensing element when the cap is in a screwed-on position on the dispensing nozzle.

2. The dispensing head of claim 1, wherein the dispensing nozzle further comprises threading configured to interact with a corresponding threading on the cap.

3. The dispensing head of claim 2, wherein the threading of the dispensing nozzle is positioned on a portion of the dispensing nozzle having a larger cross-section than the cross-section of a free end of the dispensing nozzle.

4. The dispensing head of claim 2, wherein the threading of the dispensing nozzle is separated from the dispensing orifice by at least a portion of the dispensing nozzle having a cross section increasing progressively in the direction of the threading.

5. The dispensing head of claim 4, wherein the threading of the dispensing nozzle is separated from the dispensing orifice by at least one shoulder.

6. The dispensing head of claim 2, wherein the threading of the dispensing nozzle is separated from the dispensing orifice by at least one shoulder.

7. The dispensing head of claim 2, wherein the threading of the cap is provided on an inner surface of an outer lateral wall of the cap.

8. The dispensing head of claim 1, wherein the dispensing nozzle and mounting element are distinct pieces.

9. The dispensing head of claim 1, wherein one of the dispensing nozzle and the mounting element comprises at least one tooth configured to engage at least one groove on the other of the dispensing nozzle and the mounting element so as to rotatably fix the dispensing nozzle relative to the mounting element.

10. The dispensing head of claim 1, wherein the cap comprises an edge substantially in contact with the mounting element when the cap is in the screwed-on position on the dispensing nozzle, so as to prevent actuation of the dispensing element.

11. The dispensing head of claim 10, wherein said edge of the cap is an annular edge.

12. The dispensing head of claim 1, wherein the cap is configured such that, when the cap is in the screwed-on position on the dispensing nozzle, a portion of the cap is in engagement with the dispensing orifice so as to close off the at least one dispensing orifice in a leak-tight manner.

13. The dispensing head of claim 1, wherein a portion of the dispensing nozzle is configured to interact with a corresponding portion of the mounting element to prevent detachment of the dispensing nozzle from the remainder of the dispensing head.

14. The dispensing head of claim 13, wherein said portion of the dispensing nozzle comprises an annular collar.

15. The dispensing head of claim 14, wherein said corresponding portion of the mounting element comprises an annular rim having an inner diameter less than an outer diameter of the annular collar.

16. The dispensing head of claim 1, wherein the dispensing nozzle defines the at least one dispensing orifice.

17. A dispensing device comprising:

a receptacle;

a product contained in the receptacle;

an actuatable dispensing element associated with the receptacle; and the dispensing head of claim 1.

18. The dispensing device of claim 17, wherein the dispensing element comprises a valve.

19. The dispensing device of claim 18, wherein the product contained in the receptacle is pressurized.

20. The dispensing device of claim 18, wherein the valve is a tilt-type valve configured to be actuated in response to a force oriented transverse to a longitudinal axis of the valve.

21. The dispensing device of claim 18, wherein the valve is a push-in type valve configured to be actuated in response to a force oriented along a longitudinal direction of the valve.

22. The dispensing device of claim 18, wherein the mounting element is mounted securely on the receptacle.

23. The dispensing device of claim 22, wherein the mounting element is configured to provide a clamping snap-fit connection to the receptacle.

24. The dispensing device of claim 17, wherein the product comprises a cosmetic product.

25. The dispensing device of claim 24, wherein the cosmetic product is chosen from a care product, a make-up product, a body-hygiene product, a hair-care product, and a sun-screen product.

26. The dispensing device of claim 17, wherein the mounting element is removable mounted on the receptacle.

* * * * *